US005200788A

United States Patent [19]

Thayer

[11] Patent Number: 5,200,788

[45] Date of Patent: Apr. 6, 1993

[54] BRUSH AUGER RECLAIM FILTRATION IN A PHOTORECEPTOR CLEANER HOUSING

[75] Inventor: Bruce E. Thayer, Webster, N.Y.

[73] Assignee: Xerox Corporation, Stamford, Conn.

[21] Appl. No.: 787,201

[22] Filed: Nov. 4, 1991

[51] Int. Cl.[5] ..... G03G 21/00

[52] U.S. Cl. ..... 355/298

[58] Field of Search ..... 355/298, 301-304, 355/211, 296; 209/300; 118/652

[56] References Cited

U.S. PATENT DOCUMENTS

| | | | |
|---|---|---|---|
| 3,678,896 | 7/1972 | Hewitt | 118/637 |
| 3,752,576 | 6/1973 | Gerbasi | 355/15 |
| 4,054,381 | 10/1977 | Bernhard | 355/15 |
| 4,213,794 | 7/1980 | Wooding et al. | 134/6 |
| 4,319,832 | 3/1982 | Sakamoto et al. | 355/15 |
| 4,389,968 | 6/1983 | Satomura | 118/652 |
| 4,470,689 | 9/1984 | Nomura et al. | 355/211 |
| 4,752,805 | 6/1988 | Fukae et al. | 355/3 |
| 4,870,465 | 9/1989 | Lindblad et al. | 355/296 |

FOREIGN PATENT DOCUMENTS

| | | | |
|---|---|---|---|
| 60-22172 | 2/1985 | Japan | 355/298 |

*Primary Examiner*—Joan H. Pendegrass
*Attorney, Agent, or Firm*—T. L. Fair

[57] ABSTRACT

A brush auger reclaim filtration assembly incorporated into an open ended chamber. The brush auger is a toner reclaim filtration device that is rotatably mounted, in the chamber, to move toner and debris along a separating screen. Also contained in the housing is a mounted transport auger that rotates as it moves the reclaimed toner to the developer housing.

18 Claims, 2 Drawing Sheets

BRUSH AUGER RECLAIM FILTRATION IN A PHOTORECEPTOR CLEANER HOUSING

BACKGROUND OF THE INVENTION

This invention relates generally to a particle reclaim system, and more particularly, a brush auger that reclaims toner through filtration in a photoreceptor cleaner housing.

A system for automatically recovering residual toner and returning it to the developer housing for reuse in the development zone is described in U.S. Pat. No. 3,752,576 and U.S. Pat. No. 3,678,896 in which an endless bead chain conveyor moves between the cleaning station and the development station of a xerographic system. As provided in the cleaning systems shown in the aforementioned patents, toner cleaned from the xerographic plate at the cleaning station is moved from the cleaning station to the developer station by means of a development unit for reuse in the development process.

It has been found that toner returned to the development unit in such systems often contains contaminants and foreign matter such as paper fibers, brush fibers, metal chips, and pieces of foam which if not removed are automatically transported back to the developer housing by the above noted bead chain system. Such foreign particles often jam up the bead chain system thus necessitating cleaning or replacement of the unit in the field. If the particles pass through the bead chain conveyor system, they are returned to the developer housing and may have an adverse effect on the quality of the development system. As developer life increases, the percentage of foreign particles being constantly recirculated within the machine in the aforementioned manner gradually increases and the deleterious effects thereof become more aggravated. The only removal of contaminants under the present system occurs when either the developer is changed or the toner return system is removed and cleaned or replaced.

The reclaiming of toner removed from the photoreceptor (i.e. imaging surface) after transfer by the cleaner has been a desirable copier feature for a long time. In the past several copier programs have had toner reclaim as a mainline feature only to remove the reclaim capability late in the program development because of problems with copy quality. It is now generally accepted that some type of toner clean-up is required before used toner can be recycled back to the development housing. The rationale for this point of view is that large agglomerates of toner, paper debris and other contaminants can cause poor development and/or transfer problems. Some of the reclaimed toner may also have inherent properties which make it difficult to charge properly in the development housing or transfer to paper easily. It is an objective of this invention to remove such large agglomerates from the toner before it is returned to the developer housing.

Other toner reclaim methods have utilized a brush auger device of stiff material to screen out large particles from the cleaned toner before it is returned to the developer housing. The stiff fibers in contact with the mesh screen create high torque on the toner reclaim system. It is an objective of the present invention to reduce the torque on the system. It is also an objective of the present invention to enclose the auger reclaim system in the cleaner housing to utilize less space. A further objective of the present invention is to increase the reclaim efficiency of the toner.

The following disclosures may be relevant to various aspects of the present invention and may be briefly summarized as follows:

U.S. Pat. No. 4,870,465 to Lindblad et al. describes a toner removal apparatus employing an auger member for abrading a charge retentive surface such as a photoreceptor so that excess toner is removed. The apparatus is used in conjunction with a blade so that all toner particles are removed and simultaneously transported away from an imaging area. The abrading action of the auger aids in the removal of large paper particles and other impurities which can accumulate on the photoreceptor.

U.S. Pat. No. 4,752,805 to Fukae et al. describes a device for recycling residual developer particles which are removed from a photoconductive element by a cleaning unit in an electrophotographic machine or printer. The apparatus uses a system of perforated tubes and brush augers to transport and distribute the toner particles to a developing unit. A rotating brush auger is adjacent to a first tube and transports the released particles into the first tube. A second auger is embodied within a second tube which aids in the transport and even distribution of the particles within the developer unit. The second tube is perforated with holes that increase in diameter as one travels further away from the second tube. Thus, the residual toner is evenly distributed within the developer unit so that clear copies can be obtained.

U.S. Pat. No. 4,319,832 to Sakamoto et al. describes a toner separation and recovery apparatus which uses a cylindrical electrode to attract the oppositely charged toner particles, after which a blade scrapingly deposits them into an adjacent toner recovery chamber. A fur brush removes residual toner and foreign matter from a photoconductive drum and creates an air flow which carries the particles through a passageway where the foreign matter is deposited into a chamber while the toner adheres to the charged electrode.

U.S. Pat. No. 4,213,794 to Wooding et al. describes a cleaning apparatus having a rotating brush which removes residual toner particles from an imaging surface and an auger comb which transports the particles along a path to a collecting station for vacuum removal. The comb facilitates the removal of the toner particles from the cleaning unit as well as the transportation of the particles to a disposal system.

U.S. Pat. No. 4,054,381 to Bernhard describes a filter arrangement adapted for use in a cleaning station of an electrostatographic reproduction machine which removes foreign particles and other undesirable contaminants from residual toner prior to its collection in a reuse container. A screw type brush is located within a housing having a mesh screen and serves to transport the residual toner over the screen to separate it into size components. The large particles are collected in a waste container while the smaller particles are filtered into a recycle container.

SUMMARY OF INVENTION

Briefly stated, and in accordance with one aspect of the present invention, there is provided an apparatus for reclaiming toner removed from an imaging surface by a cleaning device. The apparatus for reclaiming toner comprises the following. A housing defining an open ended chamber. A brush auger mounted rotatably in the chamber of the housing and positioned in such a way as to receive toner and waste particles removed from the imaging surface. Means, in communication with the aforementioned brush auger, for separating the toner particles from the waste particles; and means for transporting the reclaimed particles to a location remote from the housing.

Pursuant to another aspect of the present invention, there is provided an electrophotographic printing machine, having a means for reclaiming toner from an imaging surface, by a cleaning device. The printing machine means for reclaiming toner comprises the following. A housing defining an open ended chamber. A brush auger mounted rotatably in the chamber of the housing and positioned in such a way as to receive toner and waste particles removed from the imaging surface. Means, in communication with the aforementioned brush auger, for separating the toner particles from the waste particles; and means for transporting the reclaimed particles to a location remote from the housing.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Reference is now made to the drawings where the showings are for the purpose of illustrating a preferred embodiment of the invention and not for limiting same.

Figure 1:
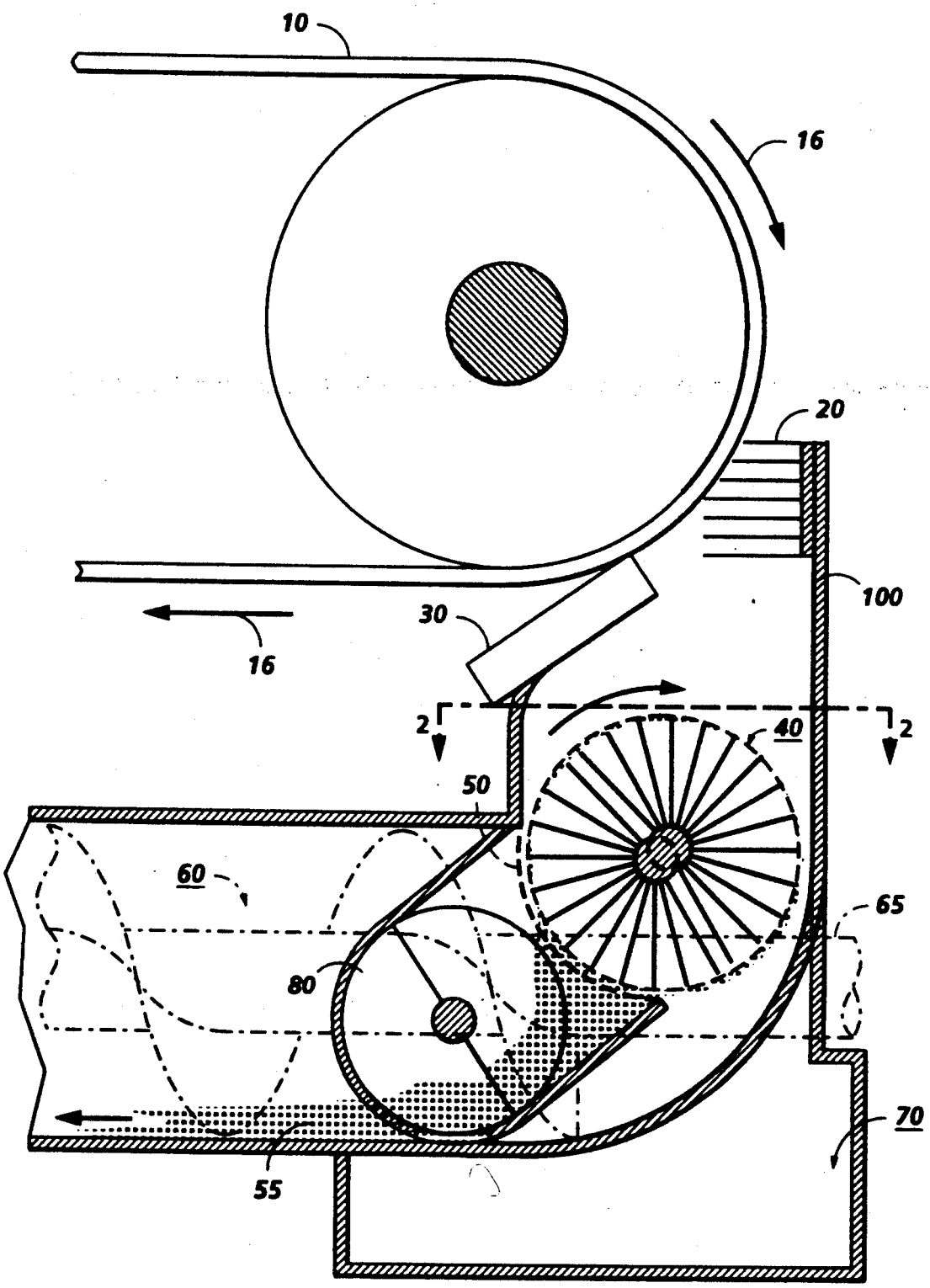
FIG. 1 is a schematic of the end view of the brush auger in a cleaner housing.

Referring now to FIG. 1 which shows an end view of a soft brush auger 40 in a cleaner housing 100. The photoreceptor 10 rotates in the direction 16. A cleaning blade 30 cleans the imaging surface of the photoreceptor 10. [Although this figure shows a cleaning blade as the cleaning device, the present invention can be used in conjunction with other cleaning devices. (e.g. brush)] The powder cloud seal 20 prevents toner from escaping from the cleaner housing 100. (Toner powder clouds off of the cleaning blade 30 tip under most conditions (maybe not in very humid environments) and this seal 20 keeps the toner powder cloud from escaping out the top of the cleaner housing 100.) As the cleaning blade 30 removes debris and excess toner from the photoreceptive surface of the photoreceptor 10, this residual material (i.e. toner, fibers, brush fibers, metal chips, pieces of foam, paper debris and other contaminants that form large particle agglomerates) falls into the soft brush auger 40. The brush auger 40 is positioned above the separation screen 50. The soft brush auger 40 moves the toner and debris particles along the separation screen 50 (e.g. mesh size ranging from 20 microns to 86 microns). In doing so, the toner particles 55, having a small diameter, fall through the mesh of the separation screen 50 into a small transport auger 80. The debris particles (i.e. fiber particles, brush fibers, metal chips, pieces of foam, paper debris and other contaminants remaining after the toner particles 55 fall through the screen 50) remain on the separation screen 50 because they are too large to fall through with the toner particles 55. Thus, the toner particles 55 are separated from the debris or waste material.

The toner particles 55 that fall into the small transport auger 80 are moved away from the separation screen by the transport auger 80. The toner dispense auger 60, operated by the auger drives input shaft 65, then takes over for the small transport auger 80 and moves the now reclaimed toner particles to the developer housing for re-use.

The larger particles of debris or waste material are moved across the screen 50 by the soft brush auger 40 until they reach the waste material container 70 where the debris is deposited.

The diameter of the brush varies with the amount of toner as well as the speed of the brush and the elastic modulus of the fiber. The well as the speed of the brush and the elastic modulus of the fiber. The speed, or rather, transport rate is a function of the auger speed, pitch, length and the brush diameter. The brush diameter also depends upon the space allowed by the screen (e.g. the brush diameter is as large as the screen space allows). The transport auger 80 and the toner dispense auger 60 are also functions of diameter, length and the amount of interference.

Figure 2:
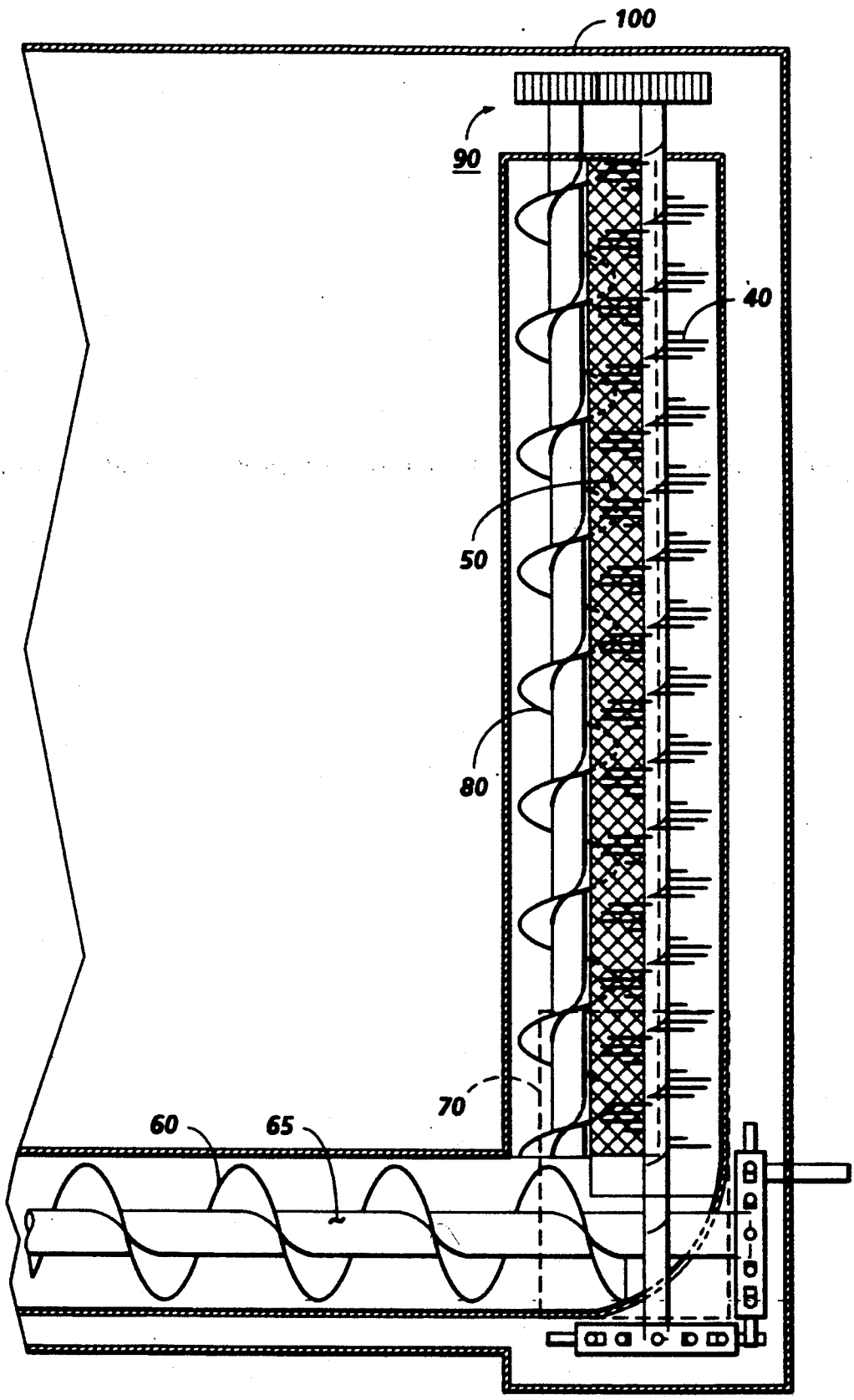
FIG. 2 is a schematic of the top view of the brush auger in a cleaner housing.

Referring now to FIG. 2 which shows a top view of a brush auger 40 incorporated into a cleaner housing 100. The brush auger 40 is located in the top channel of the cleaner housing and positioned above the separation screen 50 that has a mesh size (e.g. ranging from 20 microns to about 86 microns) that allows toner particles to fall through for reclaim but, prevents the larger particles from falling through the screen 50. The mesh size of the separation screen 50 varies considerably. The reasons for this variance include the type of weave or the material used in manufacturing the screens because the same mesh size may perform differently. The screen size is also dependent on how quickly toner flows through the screen and the quality of the reclaimed toner. The rotation of the soft brush auger 40 contacts the separation screen 50 in such a manner that the brush fibers move the toner and debris along the length of the separation screen 50 to allow separation or filtration of the smaller toner particles from the larger debris through the separation screen 50.

This figure shows a clear view of the small transport auger 80, located in the bottom channel under the screen 50, used to move the reclaimed toner, that falls through the separation screen 50, to the toner dispense auger 60. The transport auger 80 is driven by the transport auger drive gears 90 and the toner dispense auger 60 by the auger drive input 65.

The larger debris particles (i.e. large agglomerates) are moved along the separation screen 50 by the rotating brush auger 40. When the large particles or waste material have traversed to the end of the screen 50 length (e.g. 14 inches to 17 inches, however, this length covers the width of the cleaning apparatus which could be larger or smaller), there is a waste material container that captures these waste particles as they reach the end of the screen 50.

The present invention can be used in any cleaner which uses an auger to transport toner out of the cleaner. Clogging of the separation screen 50 can cause the brush auger 40 to have a limited life. Accordingly, the present invention is best suited for use in a printing machine that uses a disposable cartridge or that makes the the brush auger 40 parts replaceable. This method is both inexpensive and efficient. Sufficient volume is available in the waste container 70 to store waste material for the life of the of the print cartridge. Furthermore, since the waste container is an integral part of the print cartridge, the waste material is disposed of along with the print cartridge. As described above, the reclaim transport auger 80 moves the reclaim toner to another auger, A, which transports the reclaimed toner to the developer housing. In cases where the toner dispense auger 60 and the other auger, A, are the same, fresh toner is added to the reclaim stream to fill the auger channel.

The brush auger 40 is made from soft fibers in order to reduce the torque of the system. The fibers of the brush are made from nylon, polyethylene, polypropylene, or any plastic that does not melt or interact with the toner, and is able to withstand wear caused by contact with the screen In the present invention, the brush auger is enclosed in the cleaner housing except for on top where it is open as shown in FIG. 1. This open top design requires the use of a soft brush. The use of a stiff brush in this design would provide insufficient interference of the fibers against the separation screen for good performance in forcing the smaller toner particles through the mesh screen. The brush shaft would deflect away from the screen into the open area above the brush. By using a soft brush the deflection force is much lower, thus, preventing the brush shaft from deflecting and the need for the housing above the brush. (This lack of the housing top also decreases costs of the reclaim system.) The lower torque from the softer brushes aids in the reduction of cost. High torque requires a larger and more expensive motor, stronger and more expensive shafts and gears, etc. The power consumption of the the machine is increased and the wear of the components (i.e. shafts, gears, bearings, . . . ) is increased. The life of the brush is reduced due to wear of the brush fibers and the accumulation of toner deposits on the brush and in the screen. The wear and accumulation are increased due to the increase in heat generated by the stiff brush rubbing over the screen and the housing. This in turn will soften the toner and make it more likely to smear and stick to surfaces.

The separation screen is a length of about 14 inches to 17 inches. This length achieves better reclaim efficiency because the separation time and distance over the separation screen is increased allowing more good toner to be separated from the large agglomerates of waste material. The increased screen length also provides longer brush auger life because the screen mesh doesn't clog as soon.

In recapitulation, the present invention is a process for reclaiming toner by an auger filtration system that is enclosed in the cleaner housing. It is evident that the application of the present invention will improve copy quality to alleviate the appearance of deletions or spots. Furthermore, the present invention provides toner reclaim filtration at a lower price and with better efficiency then other printing machines that reclaim the toner. The use of soft fibers in the brush auger lowers the torque of the system below that of other auger toner reclaim filtration systems. The present invention is best suited for use in cleaner or xerographic cartridges, where the waste container can be part of a print cartridge for easy disposal.

It is, therefore, apparent that there has been provided in accordance with the present invention, toner reclaim auger filtration system enclosed in the cleaner housing that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A apparatus for reclaiming toner removed from an imaging surface by a cleaning device, comprising:

a housing defining a chamber having a top opening therein;

a brush auger, having fibers extending outwardly therefrom, mounted rotatably in the chamber of said housing and being positioned to receive, through the top opening, toner and waste particles removed from the imaging surface;

a separating member substantially impervious to the waste particles and pervious to the toner, with the fibers of said brush auger being adapted to push the toner through said member; and means for transporting toner pushed through said member by the fibers of said brush auger to a location remote from said housing.

2. An apparatus as recited in claim 1, further comprising, means, operatively associated with said separating member, for collecting the waste particles from said separating member.

3. An apparatus as recited in claim 1, wherein said brush auger has a plurality of substantially flexible brush fibers helically wound about a shaft.

4. An apparatus as recited in claim 3, wherein said brush fibers material is polyethylene.

5. An apparatus as recited in claim 1, wherein said transporting means includes a reclaim transport auger, mounted rotatably in the chamber of said housing.

6. An apparatus as recited in claim 5, wherein said separating member includes a screen mounted in the chamber of said housing between said brush auger and said reclaim transport auger to separate toner particles.

7. An apparatus as recited in claim 6, wherein said brush auger length is at least as long as said screen.

8. An apparatus as recited in claim 6, further comprising a disposable cartridge having said housing disposed therein.

9. An apparatus as recited in claim 6, wherein said screen has a mesh size ranging from about 20 microns to about 86 microns.

10. An electrophotographic printing machine, having a means for reclaiming toner removed from an imaging surface by a cleaning device, comprising:

a housing defining a chamber having a top opening therein;

a brush auger, having fibers extending outwardly therefrom, mounted rotatably in the chamber of said housing and being positioned to receive, through the top opening, toner and waste particles removed from the imaging surface;

a separating member substantially impervious to the waste particles and pervious to the toner, with the fibers of said brush auger being adapted to push the toner through said member; and means for transporting toner pushed through said member by the fibers of said brush auger to a location remote from said housing.

11. A printing machine as recited in claim 10, further comprising, means, operatively associated with said separating member, for collecting the waste particles from said separating member.

12. A printing machine as recited in claim 10, wherein said brush auger has a plurality of substantially flexible brush fibers helically wound about a shaft.

13. An apparatus as recited in claim 12, wherein said brush fibers material is polyethylene.

14. A printing machine as recited in claim 10, wherein said transporting means includes a reclaim transport auger, mounted rotatably in the chamber of said housing.

15. A printing machine as recited in claim 14, wherein said separating member includes a screen mounted in the chamber of said housing between said brush auger and said reclaim transport auger to separate toner particles.

16. A printing machine as recited in claim 15, wherein said brush auger length is at least as long as said screen.

17. A printing machine as recited in claim 15, further comprising a disposable cartridge having said housing disposed therein.

18. An apparatus as recited in claim 15, wherein said screen has a mesh size ranging from about 20 microns to about 86 microns.

* * * * *